US007667319B2

(12) United States Patent
List et al.

(10) Patent No.: US 7,667,319 B2
(45) Date of Patent: Feb. 23, 2010

(54) ELECTROOSMOTIC PUMP USING NANOPOROUS DIELECTRIC FRIT

(75) Inventors: R. Scott List, Beaverton, OR (US); Alan Myers, Portland, OR (US); Quat T. Vu, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 117 days.

(21) Appl. No.: 11/012,519

(22) Filed: Dec. 15, 2004

(65) Prior Publication Data

US 2005/0104199 A1 May 19, 2005

Related U.S. Application Data

(62) Division of application No. 10/402,435, filed on Mar. 28, 2003, now Pat. No. 6,861,274.

(51) Int. Cl.
*H01L 23/34* (2006.01)

(52) U.S. Cl. ..... 257/713; 257/712; 257/714; 438/42

(58) Field of Classification Search ..... 257/510, 257/419, 414–415, 712–714, 777, 706–707; 438/50, 53, 42; 310/328, 324; 361/699
See application file for complete search history.

(56) References Cited

U.S. PATENT DOCUMENTS

| | | | | |
|---|---|---|---|---|
| 5,494,858 | A * | 2/1996 | Gnade et al. | 438/781 |
| 6,225,223 | B1 * | 5/2001 | Liu et al. | 438/687 |
| 6,596,988 | B2 * | 7/2003 | Corso et al. | 250/288 |
| 6,720,710 | B1 * | 4/2004 | Wenzel et al. | 310/328 |
| 6,878,567 | B2 * | 4/2005 | Winer et al. | 438/53 |
| 6,905,031 | B1 * | 6/2005 | Miller et al. | 210/470 |
| 2003/0089605 | A1 * | 5/2003 | Timperman | 204/450 |
| 2003/0232203 | A1 * | 12/2003 | Mutlu et al. | 428/451 |

OTHER PUBLICATIONS

Chinese Patent Office, Office Action for Chinese Application No. 200480008679.3, 10 pages, Aug. 22, 2008.

Micromachine and microprocessing technic) pp. 59-60, Aug. 31, 2000.

* cited by examiner

*Primary Examiner*—Theresa T Doan
(74) *Attorney, Agent, or Firm*—Trop, Pruner & Hu, P.C.

(57) ABSTRACT

An electroosmotic pump may be fabricated using semiconductor processing techniques with a nanoporous open cell dielectric frit. Such a frit may result in an electroosmotic pump with better pumping capabilities.

11 Claims, 3 Drawing Sheets

ELECTROOSMOTIC PUMP USING NANOPOROUS DIELECTRIC FRIT

This application is a divisional of prior application Ser. No. 10/402,435, filed on Mar. 28, 2003.

BACKGROUND

This invention relates generally to electroosmotic pumps and, particularly, to such pumps fabricated in silicon using semiconductor fabrication techniques.

Electroosmotic pumps use electric fields to pump a fluid. In one application, they may be fabricated using semiconductor fabrication techniques. They then may be applied to the cooling of integrated circuits, such as microprocessors.

For example, an integrated circuit electroosmotic pump may be operated as a separate unit to cool an integrated circuit. Alternatively, the electroosmotic pump may be formed integrally with the integrated circuit to be cooled. Because the electroosmotic pumps, fabricated in silicon, have an extremely small form factor, they may be effective at cooling relatively small devices, such as semiconductor integrated circuits.

Thus, there is a need for better ways to form electroosmotic pumps using semiconductor fabrication techniques.

DETAILED DESCRIPTION

Figure 1:
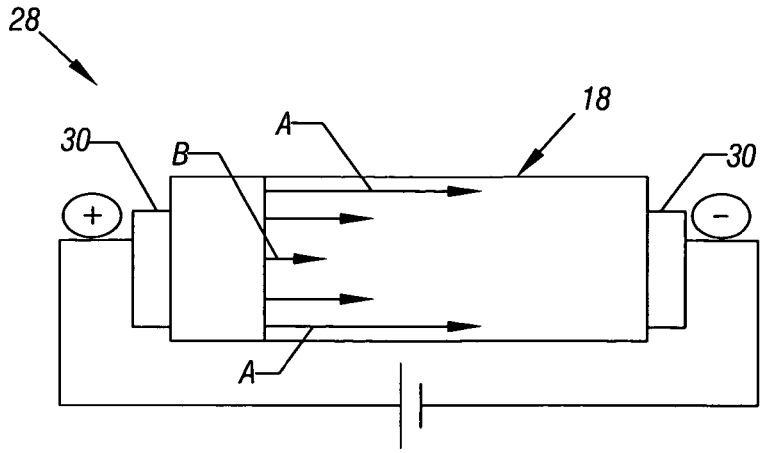
FIG. 1 is a schematic depiction of the operation of the embodiment in accordance with one embodiment of the present invention.

Referring to FIG. 1, an electroosmotic pump 28 fabricated in silicon is capable of pumping a fluid, such as a cooling fluid, through a frit 18. The frit 18 may be coupled on opposed ends to electrodes 30 that generate an electric field that results in the transport of a liquid through the frit 18. This process is known as the Electroosmotic effect. The liquid may be, for example, water and the frit may be composed of silicon dioxide in one embodiment. In this case hydrogen from hydroxyl groups on the wall of the frit deprotonate resulting in an excess of hydrogen ions along the wall, indicated by the arrows A. The hydrogen ions move in response to the electric field applied by the electrodes 30. The non-charged water atoms also move in response to the applied electric field because of drag forces that exist between the ions and the water atoms.

As a result, a pumping effect may be achieved without any moving parts. In addition, the structure may be fabricated in silicon at extremely small sizes making such devices applicable as pumps for cooling integrated circuits.

In accordance with one embodiment of the present invention, the frit 18 may be made of an open and connected cell dielectric thin film having open nanopores. By the term "nanopores," it is intended to refer to films having pores on the order of 10 to 100 nanometers. In one embodiment, the open cell porosity may be introduced using the sol-gel process. In this embodiment, the open cell porosity may be introduced by burning out the porogen phase. However, any process that forms a dielectric film having interconnected or open pores on the order of 10 to 100 nanometers may be suitable in some embodiments of the present invention.

For example, suitable materials may be formed of organosilicate resins, chemically induced phase separation, and sol-gels, to mention a few examples. Commercially available sources of such products are available from a large number of manufacturers who provide those films for extremely low dielectric constant dielectric film semiconductor applications.

In one embodiment, an open cell xerogel can be fabricated with 20 nanometer open pore geometries that increase maximum pumping pressure by a few orders of magnitude. The xerogel may be formed with a less polar solvent such as ethanol to avoid any issues of water tension attacking the xerogel. Also, the pump may be primed with a gradual mix of hexamethyldisilazane (HMDS), ethanol and water to reduce the surface tension forces. Once the pump is in operation with water, there may be no net forces on the pump sidewalls due to surface tension.

Referring to FIGS. 2-9, the fabrication of an electroosmotic pump 28 using a nanoporous open cell dielectric frit 18 begins by patterning and etching to define an electroosmotic trench.

Figure 2:
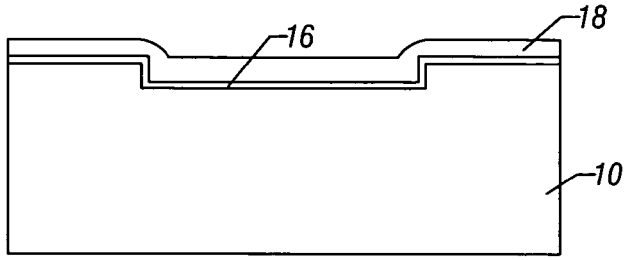
FIG. 2 is an enlarged cross-sectional view of one embodiment of the present invention at an early stage of manufacture.

Referring to FIG. 2, a thin dielectric layer 16 may be grown over the trench in one embodiment. Alternatively, a thin etch or polish-stop layer 16, such as a silicon nitride, may be formed by chemical vapor deposition. Other techniques may also be used to form the thin dielectric layer 16. The nanoporous dielectric layer 18 may than be formed, for example, by spin-on deposition. In one embodiment, the dielectric layer 18 may be in the form of a sol-gel. The deposited dielectric layer 18 may be allowed to cure.

Figure 3:
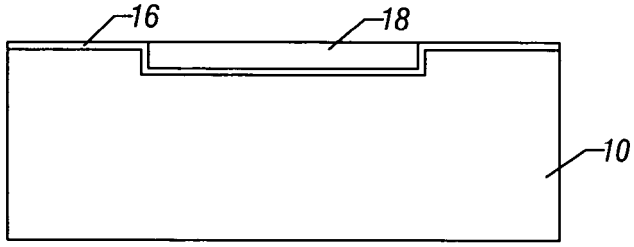
FIG. 3 is an enlarged cross-sectional view at a subsequent stage of manufacture in accordance with one embodiment of the present invention.

Then, referring to FIG. 3, the structure of FIG. 2 may be polished or etched back to the stop layer 16. As a result, a nanoporous dielectric frit 18 may be defined within the layer 16, filling the substrate trench.

Figure 4:
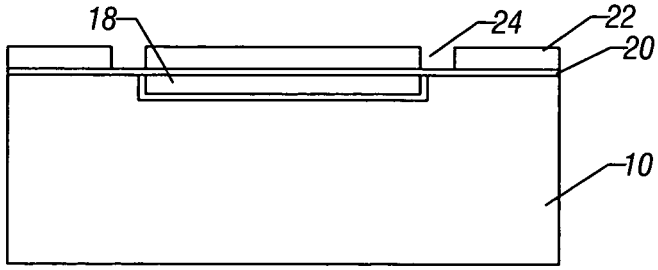
FIG. 4 is an enlarged cross-sectional view at a subsequent stage of manufacture in accordance with one embodiment of the present invention.

Referring next to FIG. 4, openings 24 may be defined in a resist layer 22 in one embodiment of the present invention. The openings 24 may be effective to enable electrical connections to be formed to the ends of the frit 18. Thus, the openings 24 may be formed down to a deposited oxide layer 20 that may encapsulate the underlying frit 18. In some embodiments, the deposited oxide layer 20 may not be needed.

Figure 5:
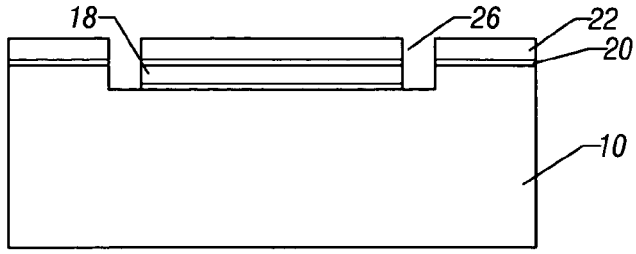
FIG. 5 is an enlarged cross-sectional view at a subsequent stage of manufacture in accordance with one embodiment of the present invention.
Figure 6:
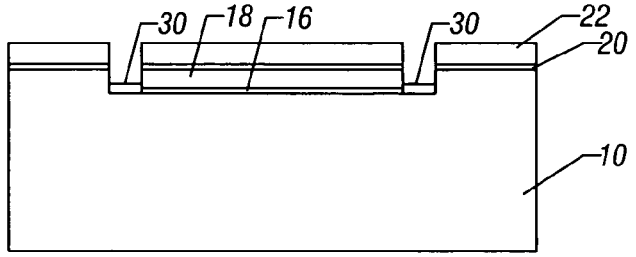
FIG. 6 is an enlarged cross-sectional view at a subsequent stage of manufacture in accordance with one embodiment of the present invention.

The resist 22 is patterned as shown in FIG. 4, the exposed areas are etched and then used as a mask to form the trenches 26 alongside the nanoporous dielectric layer 18 as shown in FIG. 5. Once the trenches 26 have been formed, a metal 30 may be deposited on top of the wafer In one embodiment, sputtering can be used to deposit the metal. The metal can be removed by etching of lift-of techniques in such a manner as to leave metal only in the trench at the bottom of the trenches 26 as shown in FIG. 6. The metal 30 is advantageously made as thin as possible to avoid occluding liquid access to the exposed edge regions of the frit 18, which will ultimately act as the entrance and exit openings to the pump 28.

Figure 7:
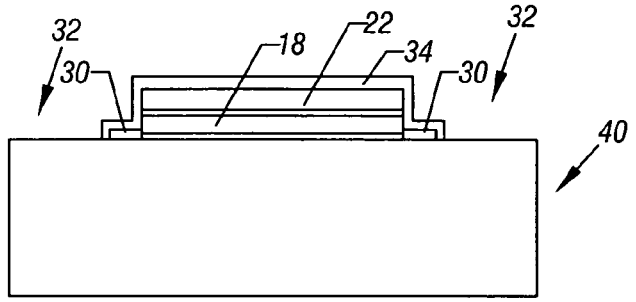
FIG. 7 is an enlarged cross-sectional view taken along the lines 7-7 in FIG. 8 at a subsequent stage of manufacture in accordance with one embodiment of the present invention.
Figure 8:
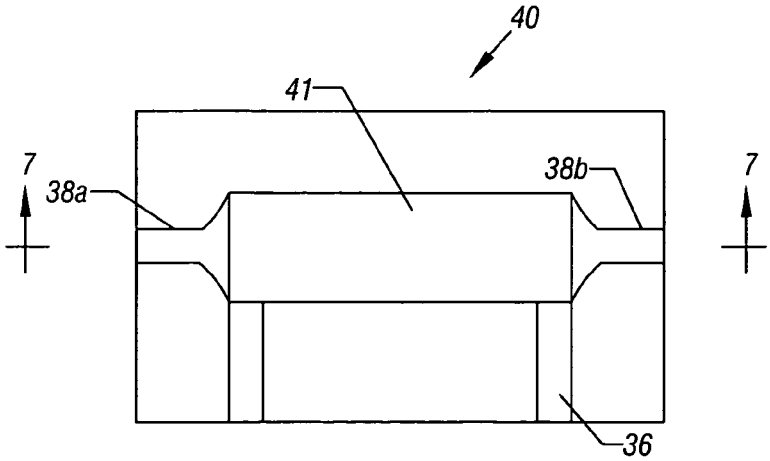
FIG. 8 is a top plan view of the embodiment shown in FIG. 8 in accordance with one embodiment of the present invention.

Referring to FIG. 7, a chemical vapor deposition material 34 may be formed over the frit 18 and may be patterned with photoresist and etched, as indicated at 32, to provide for the formation of microchannels 38 shown in FIG. 8. The microchannels 38 act as conduits to convey liquid to and from the rest of the pump 41. Also, electrical interconnections 36 may be fabricated by depositing metal (for example by sputtering), and removing the metal in selected areas (for example by lithographic patterning and etching across the wafer to enable electrical current to be supplied to the contacts 30. This current sets up an electric field that is used to draw the fluid through the pump 28.

Figure 9:
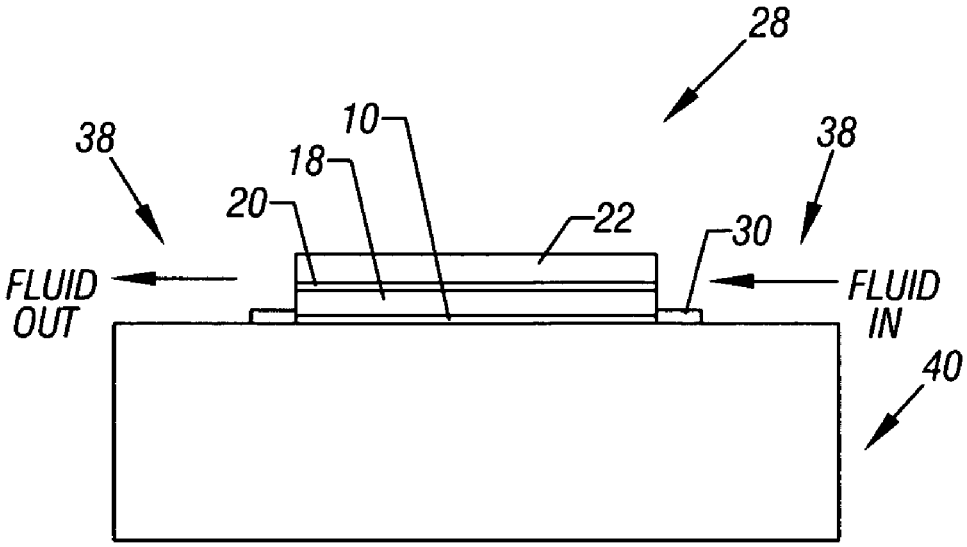
FIG. 9 is an enlarged cross-sectional view of a completed structure in accordance with one embodiment of the present invention.

Referring to FIG. 9, the fluid may pass through the microchannels 38 and enter the frit 18 by passing over the first contact 30. The fluid is drawn through the frit 18 by the electric field and the disassociation process described previously. As a result, the fluid, which may be water, is pumped through the pump 28.

Figure 10:
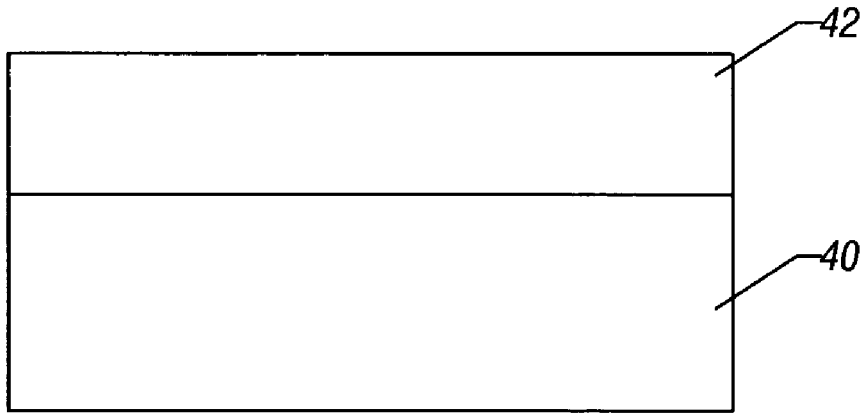
FIG. 10 is an enlarged cross-sectional view of one embodiment of the present invention.

Referring to FIG. 10, the substrate 10 may be separated into dice and each die 40 may be secured to a die 42 to be cooled, in one embodiment of the present invention. For example, the dice 40 and 42 may be interconnected by silicon dioxide bonding techniques, as one example. Alternatively, the pump 28 may be formed directly in the die 42 to be cooled in the wafer stage, for example, on its backside.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. An electroosmotic pump comprising:
a semiconductor die;
a trench formed in said die, said trench having opposite ends;
a nanoporous open cell dielectric in said trench;
a pair of electrodes on both opposite ends of said trench to apply an electric field across said dielectric; and
flow channels in said die on opposite sides of said dielectric to allow fluid flow through said dielectric from an inlet on one of said sides to an outlet on the other of said sides.

2. The pump of claim 1 wherein said open cell dielectric is a sol-gel.

3. The pump of claim 1 wherein said electrodes are formed of sputtered metal on either side of said dielectric.

4. The pump of claim 1 including a second dielectric layer between said dielectric and said die.

5. The pump of claim 1 wherein said flow channels allow fluid to flow over an electrode and through said dielectric.

6. The pump of claim 1 wherein said dielectric includes xerogel.

7. An electroosmotic pump comprising:
a semiconductor substrate;
a trench formed in said substrate, said trench having opposite sides;
a dielectric in said trench;
a pair of electrodes on opposite sides of dielectric to apply an electric field across said dielectric;
said dielectric having a nanoporous open cell structure such that fluid can pass through said open cell structure across said dielectric; and
flow channels to provide fluid flow to or from said substrate and into said trench, said flow channels in said substrate, said flow channels to allow fluid flow through said dielectric.

8. The pump of claim 7 wherein said dielectric is a sol-gel.

9. The pump of claim 7 including a second dielectric layer between said dielectric and said substrate.

10. The pump of claim 7 including channels formed through said dielectric to allow fluid to pass through said structure in said dielectric.

11. The pump of claim 7 wherein said dielectric includes xerogel.

* * * * *

UNITED STATES PATENT AND TRADEMARK OFFICE

CERTIFICATE OF CORRECTION

PATENT NO. : 7,667,319 B2
APPLICATION NO. : 11/012519
DATED : February 23, 2010
INVENTOR(S) : List et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 0 days.

Signed and Sealed this

Fourth Day of January, 2011

David J. Kappos

David J. Kappos
*Director of the United States Patent and Trademark Office*